US008834753B2

(12) United States Patent
Hung et al.

(10) Patent No.: US 8,834,753 B2
(45) Date of Patent: Sep. 16, 2014

(54) PROCESS OF MAKING YARNS WITH COFFEE RESIDUE

(75) Inventors: Shuo-Ting Hung, Taipei County (TW); Yi-Yen Yeh, Taipei County (TW); Chien-Kuo Yen, Taipei County (TW); Kuo-Chin Chen, Taipei County (TW)

(73) Assignee: Magictex Apparel Corporation, Taipei Hsien (TW)

( * ) Notice: Subject to any disclaimer, the term of this patent is extended or adjusted under 35 U.S.C. 154(b) by 1246 days.

(21) Appl. No.: 11/876,201

(22) Filed: Oct. 22, 2007

(65) Prior Publication Data

US 2009/0100655 A1 Apr. 23, 2009

(51) Int. Cl.

| | |
|---|---|
| ***D01F 1/02*** | (2006.01) |
| ***D01F 1/10*** | (2006.01) |
| ***D02G 3/02*** | (2006.01) |

(52) U.S. Cl.

CPC .. *D02G 3/02* (2013.01); *D01F 1/10* (2013.01); *D10B 2321/022* (2013.01); *D10B 2331/02* (2013.01); *D10B 2331/04* (2013.01)

USPC ..... 264/29.1; 264/211

(58) Field of Classification Search

USPC ..... 264/29.1, 211

See application file for complete search history.

(56) References Cited

U.S. PATENT DOCUMENTS

| | | | | |
|---|---|---|---|---|
| 3,499,851 | A * | 3/1970 | Ligo | 524/9 |
| 2002/0037406 | A1 * | 3/2002 | Takashima | 428/364 |
| 2002/0173583 | A1 * | 11/2002 | Shimizu | 524/515 |
| 2004/0126662 | A1 * | 7/2004 | Kohno et al. | 429/231.4 |
| 2005/0107505 | A1 * | 5/2005 | Shinoda et al. | 524/321 |
| 2007/0148320 | A1 * | 6/2007 | Uchiyama | 426/634 |

* cited by examiner

*Primary Examiner* — Leo B Tentoni

(74) *Attorney, Agent, or Firm* — Whyte Hirschboeck Dudek S.C.

(57) ABSTRACT

The present invention provides to a preparation of a yarn with coffee residue. The present invention also provide to a novel yarn with coffee residue.

5 Claims, 2 Drawing Sheets

PROCESS OF MAKING YARNS WITH COFFEE RESIDUE

FIELD OF THE INVENTION

The present invention relates to a preparation of yarns with coffee residue. The present invention also relates to a novel yarn with coffee residue.

BACKGROUND

The design and development of a functional textile providing an ability of dynamic heat regulation next to the skin have attracted more and more attention in recent years. Number of attempts in this field is extensive parallel to the researches in electronics, several solar energy-based systems, buildings, etc. However, successful applications are limited and still under investigation.

It is well known that various materials such as fabrics, clothing, and other apparel can be treated to enhance the performance characteristics associated with the material. The performance characteristics can include, for example, odor adsorption, moisture control, ultra-violet light protection, and/or protection from external elements.

Certain materials naturally exhibit certain performance characteristics without being treated with chemicals or additives. For example, apparel constructed from an untreated material such as Lycra exhibits a moisture management characteristic. Materials such as Lycra; however, may not exhibit any other characteristics such as odor adsorption and/or ultraviolet protection. In addition, apparel constructed from untreated materials is limited to the physical properties (e.g., texture, feel, durability, etc.) associated with that untreated material. Moreover, the performances characteristics of such materials are often limited and do not adequately enhance the material.

After the chemicals are applied, however, the chemicals often dissipate and have to be reapplied continuously throughout the life of the fabric to impart the desired characteristics. The chemicals may dissipate, for example, when the treated fabric is washed or exposed to external elements.

It is therefore desirable to produce a high performance fabric that has desirable physical properties such as texture and durability, provides superior performance characteristics, and retains those performance characteristics after repeated use. Such a high performance fabric can be produced by treating the yarn or fiber prior to use the yarn or fiber to produce the desired material.

Approaches have been attempted to bind solid particles such as activated carbon to yarn prior to producing a fabric. Activated carbon is a granular substance that varies in size and shape depending on the process used to create the activated carbon. The activated carbon's surface area is covered with pores that also vary in size and shape depending on how it is produced. These pores provide the activated carbon with properties such as odor adsorption.

One approach involves incasing a layer of activated carbon between two layers of fabric. This technique, however, yields an odor adsorbing fabric that is heavy and cumbersome for a person to wear. Another approach that has been attempted is to incorporate the active carbon into a sheathing layer that surrounds the yarn. This approach, however, alters the physical property of yarn.

Human activity generates a great many unpleasant odors in the environment. The nature of these unpleasant odors is highly varied both on account of the physical state of the unpleasant odor particles and their chemical characteristics or their origin (biological decomposition, chemical agents, smoking, etc.). In addition, these unpleasant odors are generated in spaces or environments of everyday use such as the bathroom, kitchen, refuse, closed environments with fumes (bars), etc. In this respect, many systems have been developed to combat such unpleasant odors.

SUMMARY OF THE INVENTION

The present invention provides a method for preparing a yarn with coffee residue, comprising (a) providing a material with coffee residue;

(b) blending the material with a polymer chip to produce a master batch; and (c) drawing a yarn from the master batch.

The present invention also provides yarn with coffee residue, comprising a yarn and a material with coffee residue.

The present invention further provides a fabric comprising the yarn of the present invention.

DETAILED DESCRIPTION OF THE INVENTION

Figure 1:
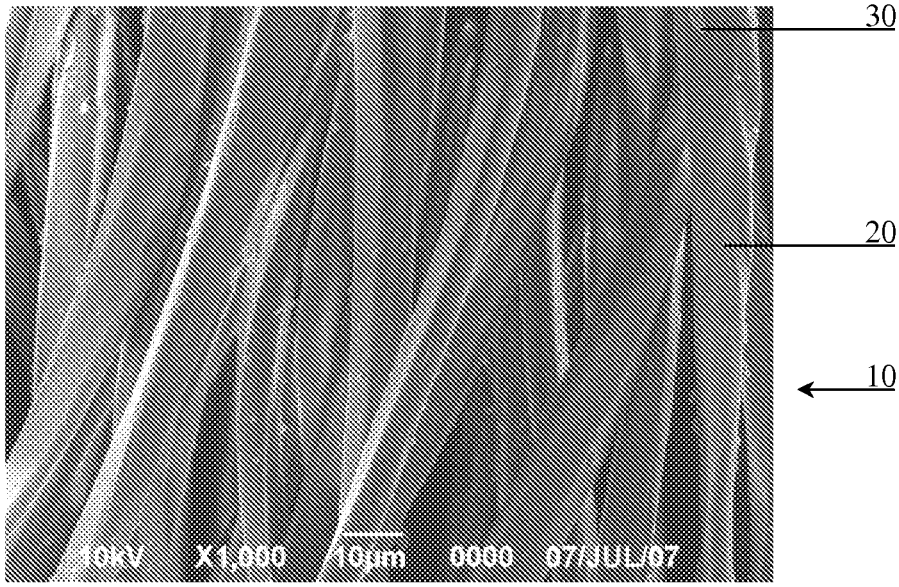
FIG. 1 is a ×1,000 Scanning Electron Microscopy (SEM) diagram of yarns with coffee residue wherein 10 represents yarn with coffee residues, 20 represents a piece of yarn and 30 represents a coffee residue.
Figure 2:
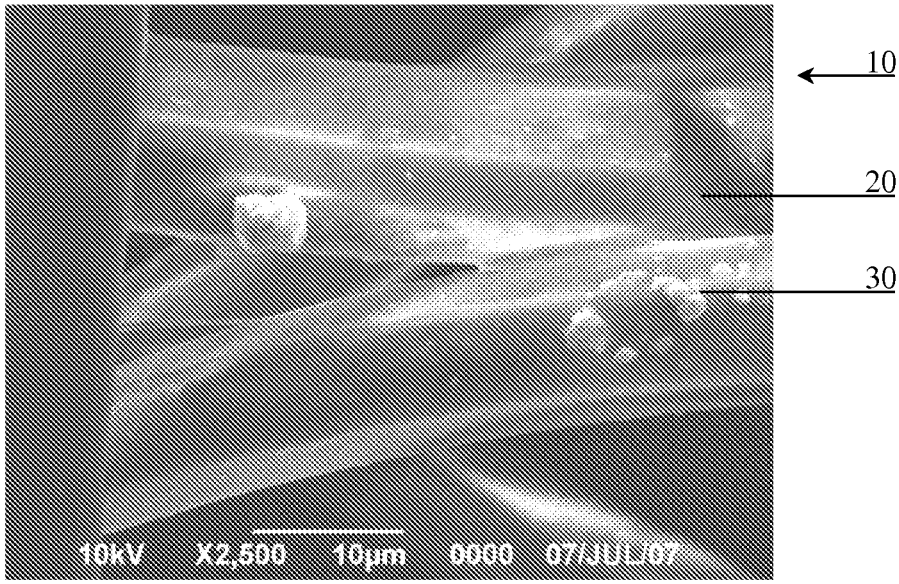
FIG. 2 is a ×2,500 SEM diagram of yarns with coffee residue, wherein 10 represents yarns with coffee residues, 20 represents a piece of yarn and 30 represents a coffee residue.
Figure 3:
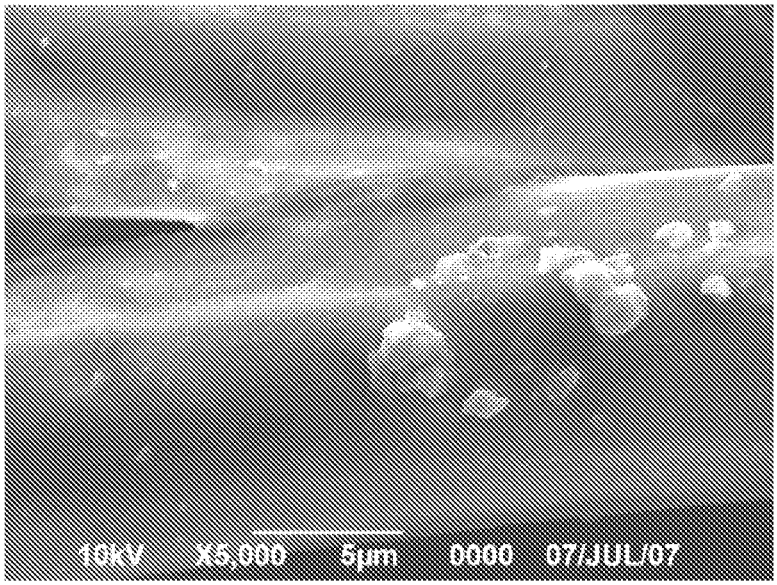
FIG. 3 is a ×5,000 SEM diagram of yarns with coffee residue.

For a long time, coffee residues have been viewed as litter after the beverages coffee had been made. However, this present invention provides an environmental-friendly way to recycle the coffee residues by incorporating them into the preparation of yarns.

The present invention relates to a method for preparing a yarn with coffee residue, comprising (a) providing a material with coffee residue; (b) blending the material with a polymer chip to produce a master batch; and (c) drawing a yarn from the master batch. The material used in the present invention is backed coffee residue, microencapsulated baked coffee residue, microencapsulated coffee essential oil, or microencapsulated fragrance organic compounds which are extracted from coffee residue. In the preferred embodiment, the coffee residue is ground coffee beans or coffee dregs. The above-mentioned material is further comprises a carbonized particle which is prepared from carbonized coffee particle, carbonized coconut particle or carbonized bamboo particle. In addition, the carbonized coffee particle is prepared by sieving coffee residue, removing organic contents from the sieved mixture, and then obtaining carbonized particles from the mixture without organic contents. Furthermore, the polymer chip in the prevent invention is selected from the group consisting of PP, Nylon or PET.

The present invention also provides a yarn, comprising a yarn and a material with coffee residue. In a preferred embodiment, the coffee residue has coffee fragrance. The material further comprises a carbonized particle. In addition this yarn can be used to make garment.

The present invention also provides a yarn with coffee fragrance, comprising a yarn which is prepared by the above-mentioned method and a material with coffee residue which has coffee fragrance. The material further comprises a carbonized particle. In addition this yarn can be used to make garment.

The present invention further provides a fabric comprising one of the above-mentioned yarns. The fabric is a non-woven fabric, a woven fabric, or a knitted fabric.

EXAMPLES

Example 1

Preparation of Material with Coffee Residue and Carbonized Coffee Particles

1. Preparation of Material with Coffee Residue

The term "material with coffee residue" includes but is not limited to baked coffee residue, microencapsulated baked coffee residue; microencapsulated coffee essential oil; microencapsulated fragrance organic compounds which are extracted from coffee residue. Coffee residue could be ground coffee beans or coffee dregs in coffee shop. Then, the coffee residue was baked. Coffee essential oil could be extracted from coffee bean. The baked coffee residue or coffee essential oil was microencapsulated.

2. Sieving Coffee Residue or Raw Material

The coffee bean waste was rinsed in clean tap water, and then dried and ground to a particle size of 20 to 100 microns. Ground coffee beans were directly sieved. Alternatively, coffee dregs were dried and ground. Then, the ground mixture was sieved. The resulting composition can be sieved into different fine particles sizes of between 80 to 100 μm.

3. Removal of Organic Contents of Sieved Mixture

The sieved mixture was extracted by organic solvent to remove organic contents of the mixture. The extraction of the fat was carried out in a large Soxhlet type extractor with ethyl ether. The temperature of the extract was kept below 60° C. In all subsequent operations, air was excluded as far as possible by the use of inert gases and all solvents were freshly distilled. The lipids were treated with acetone to remove the phospholipids after which the acetone-soluble fat was recovered and saponified by refluxing with an excess of 5% alcoholic potassium hydroxide solution. The soap solution was acidified with 0.1N hydrochloric acid and the fatty acids were extracted with ether. After the fatty acids had been removed, the aqueous solution containing the water-soluble constituents was evaporated to dryness under reduced pressure and extracted with absolute alcohol for the removal of glycerol.

4. Preparation of Carbonized Particles

The mixture from step 2 was carbonized by carbonization known in the state-of-art. For example, pyrolysis is the process in which coffee mixture is heated, decomposed and eventually converted into desired product in absence of air in the fixed bed reactor. The pyrolysis includes carbonization (destructive/dry distillation of wood), charcoal processing, gasification, activated carbon processing. The pyrolysis products are wood charcoal and activated carbon. The carbonization of the coffee raw materials is done normally in the presence of chemical agents such as zinc chloride, magnesium chloride, calcium chloride or phosphoric acid. The carbonized material is treated with oxidizing gas in a furnace at 800-1000° C. under the conditions that permit removal of nearly all the adsorbed hydrocarbons and some of the carbon to increase the surface area.

Before subjecting the carbonized material for activation, it is washed with either acid or base depending upon the chemical used for carbonization to remove all the traces. Then it is charged for activation. Various methods are used for the activation process but the most widely used are the treatment of the carbonaceous material with oxidizing gases such as air, steam or carbon dioxide. This technique is generally used for the activation of coffee mixture, subsequent to carbonization. The charcoal is activated by reaction with steam at a temperature of 800-1100° C. under controlled atmosphere in a fluidized bed reactor to facilitate uniform heat distribution and improved gas-solid contact. The reaction between steam and charcoal takes place at the internal surface area, creating more sites for adsorption with liberation of gases such as $H_2$, $CO_2$ and CO.

Initially, gasification of the carbonized material with steam occurs and the following reaction, known as the Water-Gas reaction, takes place:

$$C+H_20 \rightarrow CO+H_2-175{,}440 \text{ kJ/(kg mol)}$$

This reaction being endothermic, temperature is maintained by partial burning of the CO and $H_2$ formed, as follows:

$$2CO+O_2 \rightarrow 2CO_2+393{,}790 \text{ kJ/(kg mol)}$$

$$2H_2+O_2 \rightarrow 2H_2O+396{,}650 \text{ kJ/(kg mol)}.$$

5. Preparation of Master Batch

75% of the carbonized particles and 25% the material with coffee fragrance were mixed and were ground to fine particles less than 5 μm; then, the ground particles and polymer chip (such as PP, Nylon or PET) in a weight ratio of 1:9 were blended to prepare master batch. Alternatively, 75% of the carbonized particles and 25% the material with coffee fragrance were blended into polymer chip (such as PP, Nylon or PET) to make master batch.

6. Drawing Yarn

The master batch was made in the industrially accepted concentrations and added to the polymeric slurry the same way any other master batch would be added such as for pigmentation, etc. As stated in Billie J. Collier et al., Understanding Textiles sixth edition, pressed by Prentice Hall, the master batch was designed in such a way as to allow fiber extrusion in the normal production systems. The fibers could be cut into short staple or produced in filament form and texturized, if so desired. The product yielded was a fiber that can be introduced at the blending stage of yarn production or directly into a woven or knit product so that no manufacturing processes were changed.

What is claimed is:

1. A method for preparing a yarn with coffee residue, comprising (a) removing organic contents from a material with coffee residue;

(b) after the step (a), mixing the material with a carbonized particle to form a mixture;

(c) blending the mixture with a polymer chip in a weight ratio of 1:9 to produce a master batch; and (d) drawing a yarn from the master batch.

2. The method of claim 1, wherein the material is baked coffee reside, microencapsulated baked coffee residue; microencapsulated coffee essential oil; microencapsulated fragrance organic compounds which are extracted from coffee residue.

3. The method of claim 2, wherein the coffee residue is ground coffee beans or coffee dregs.

4. The method of claim 1, wherein the carbonized particle is prepared from carbonized coffee particles, carbonized coconut particle or carbonized bamboo particle.

5. The method of claim 1, wherein the polymer chip is PP, Nylon or PET.

* * * * *